US011466436B1

(12) United States Patent
Wurmnest et al.

(10) Patent No.: US 11,466,436 B1
(45) Date of Patent: Oct. 11, 2022

(54) WEAR PART REMOVAL SYSTEM

(71) Applicant: Caterpillar Inc., Peoria, IL (US)

(72) Inventors: Kyle R. Wurmnest, Deer Creek, IL (US); Phillip J. Kunz, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/211,560

(22) Filed: Mar. 24, 2021

(51) Int. Cl.
*E02F 9/28* (2006.01)

(52) U.S. Cl.
CPC ..... *E02F 9/2891* (2013.01)

(58) Field of Classification Search
CPC .... E02F 9/2891; E02F 9/28; Y10T 29/53704; Y10T 29/53835; E21C 35/188
USPC ..... 254/104; 29/700
See application file for complete search history.

(56) References Cited

U.S. PATENT DOCUMENTS 1,866,125 A * 7/1932 Patterson ..... B67B 7/02 29/244
1,945,476 A * 1/1934 Blazek ..... B25B 27/02 29/239
1,984,960 A * 12/1934 Beard ..... B25B 27/06 29/253
2,124,230 A * 7/1938 Hosmer ..... E02F 9/2891 37/460
2,704,093 A * 3/1955 Brown ..... B27M 3/02 144/195.1
2,798,403 A * 7/1957 Launder ..... E02F 9/2841 37/457
3,106,256 A * 10/1963 McBride ..... F16B 2/243 411/352
3,290,769 A * 12/1966 Kashergen ..... E02F 9/2891 254/131
3,342,531 A * 9/1967 Krekeler ..... E21C 35/19 175/413
3,769,683 A * 11/1973 Krekeler ..... E21C 35/193 299/95
3,982,572 A * 9/1976 Kortendick ..... B27L 7/005 144/195.7
4,611,418 A * 9/1986 Launder ..... E02F 9/2891 403/328
4,846,287 A 7/1989 Ericsson
(Continued)

FOREIGN PATENT DOCUMENTS

CN 108411975 A 8/2018
CN 109772773 A 5/2019
CN 209873908 U 12/2019

*Primary Examiner* — Jacob J Cigna
*Assistant Examiner* — Michael W Hotchkiss
(74) *Attorney, Agent, or Firm* — Harrity & Harrity LLP

(57) ABSTRACT

A wear part removal system includes a first wedge assembly configured to engage with a first joint associated with a wear part; a second wedge assembly configured to engage with a second joint associated with the wear part; a ram component configured to cause the first wedge assembly to engage with the first joint associated with the wear part and to cause the second wedge assembly to engage with the second joint associated with the wear part; and a frame configured to hold the first wedge assembly, the second wedge assembly, and the ram component. A wedge assembly, of the first wedge assembly or the second wedge assembly, includes a wedge component configured to engage with a joint associated with the wear part and a wedge component saddle configured to hold the wedge component.

19 Claims, 11 Drawing Sheets

(56) References Cited

U.S. PATENT DOCUMENTS

| | | | | |
|---|---|---|---|---|
| 5,071,183 | A * | 12/1991 | McDermott | E02F 3/968 294/81.5 |
| 6,108,950 | A | 8/2000 | Ruvang et al. | |
| 6,112,784 | A * | 9/2000 | Lough | B27L 7/00 144/195.1 |
| 6,637,295 | B2 * | 10/2003 | Weaver | B67B 7/066 81/3.39 |
| 7,520,570 | B2 * | 4/2009 | Sansone | E02F 9/2891 299/95 |
| 7,891,084 | B1 * | 2/2011 | Sollami | E02F 9/2866 29/760 |
| 9,157,320 | B2 * | 10/2015 | Lehnert | B25B 27/023 |
| 9,464,411 | B2 | 10/2016 | Tanaka et al. | |
| 2009/0293249 | A1 * | 12/2009 | Lehnert | B25B 27/026 29/270 |
| 2010/0077591 | A1 * | 4/2010 | Sanvaliya | B02C 4/08 29/700 |
| 2012/0222335 | A1 * | 9/2012 | Charlton | E02F 9/2891 29/253 |
| 2015/0107075 | A1 * | 4/2015 | Clarke | B25J 15/0066 29/703 |
| 2017/0356167 | A1 * | 12/2017 | Paul | B25J 15/0491 |
| 2020/0102722 | A1 * | 4/2020 | Saunders | E02F 9/2891 |

* cited by examiner

200

200

200

WEAR PART REMOVAL SYSTEM

TECHNICAL FIELD

The present disclosure relates generally to wear part removal and, for example, to a wear part removal system.

BACKGROUND

Earth-moving machines such as excavators, wheel loaders, and track-type tractors and loaders commonly include an implement structured for digging, cutting, breaking apart, removing, breaking, carrying, or otherwise manipulating materials such as rock, soil, sediment, or waste, to name a few examples. The implement is often subjected to regular and repeated wear along an edge of the implement caused by engagement with the materials. In order to protect the edge, the implement may include one or more replaceable wear parts (also referred to as ground engaging tools (GETs)), such as teeth, couplers, adapters, lip shrouds, and/or caps. The one or more replaceable wear parts then bear the majority of the abrasion, impact, or other forces that typically cause wear or damage while the implement is in service.

Over time, due to wear or damage to a replaceable wear part, the replaceable wear part may degrade, fail, or otherwise need to be replaced. Replacing the replaceable wear part requires the replaceable wear part to be detached from an adapter or mount. However, this is often difficult because impacted fines, dust, or dirt on the replaceable wear part may cause the replaceable wear part to adhere to (e.g., be stuck on) the adapter or mount. This requires a large pulling force, or other means for removing or loosening the impacted fines, dust, or dirt, to enable removal of the replaceable wear part. For example, a worker may use hand tools to physically loosen and/or remove the replaceable wear part (e.g., use a sledge hammer to hammer the wear part to cause the wear part to detach from an adapter). Further, environmental conditions, such as heat, cold, rain, snow, sleet, ice, uneven terrain, limited working area, and/or the like, make removing a replaceable wear part difficult and/or time consuming.

U.S. Patent Application Publication No. 2012/0222335 (the '335 publication) discloses tools for facilitating the disassembly of components, such as excavation tooth assemblies. Per the '335 publication, a disassembly tool comprises first and second legs where each leg has a robust body and an integrally formed flange that has a wedge shaped portion in the form of a ramp surface. The ramp surfaces of the legs can engage with side portions of a collar of a digging point and the disassembly tool is adapted to be hammered vertically downwardly so as to cause separation of the digging point from an adapter.

While the '335 publication discloses a disassembly tool for causing separation of a digging point from an adapter, the disassembly tool requires an operator to manually apply hammer blows or a percussive force to the disassembly tool to cause separation of the digging point from the adapter. Further, in some cases, when the digging point is worn and/or damaged, or the digging point is wet or covered in ice, among other examples, the ramp surfaces of the legs of the disassembly tool may not be able to maintain a position on the side portions of a collar of the digging point. Therefore, in such cases, the disassembly tool cannot separate the digging point from the adapter. The wear part removal system of the present disclosure solves one or more of the problems set forth above and/or other problems in the art.

SUMMARY

A wear part removal system includes a first wedge assembly configured to engage with a first joint associated with a wear part; a second wedge assembly configured to engage with a second joint associated with the wear part; a ram component configured to cause the first wedge assembly to engage with the first joint associated with the wear part and to cause the second wedge assembly to engage with the second joint associated with the wear part; and a frame configured to hold the first wedge assembly, the second wedge assembly, and the ram component.

A wear part removal system includes a first wedge assembly configured to engage with a first joint associated with a wear part; a second wedge assembly configured to engage with a second joint associated with the wear part; and a ram component configured to cause the first wedge assembly to engage with the first joint associated with the wear part and to cause the second wedge assembly to engage with the second joint associated with the wear part.

A wedge assembly includes a wedge component configured to engage with a joint associated with a wear part; and a wedge component saddle configured to hold the wedge component.

DETAILED DESCRIPTION

This disclosure relates to a wear part removal system, which is applicable to any machine that needs removal of a wear part. The term "machine" may refer to any machine that performs an operation associated with an industry such as, for example, mining, construction, farming, transportation, or other industry. For example, the machine may be an earth-moving machine or material-moving machine, such as an excavator, a wheel loader, or a track-type tractor and loader, among other examples.

Figure 1A:
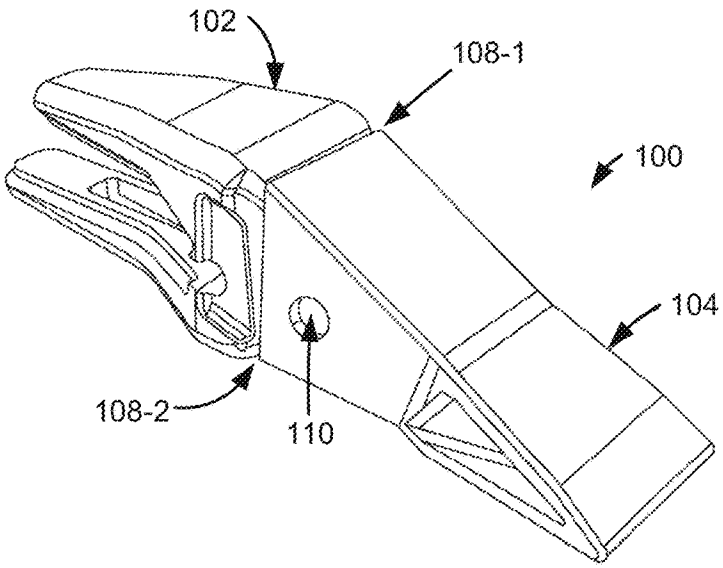
FIGS. 1A-1B are diagrams of an example wear part assembly described herein.
Figure 1B:
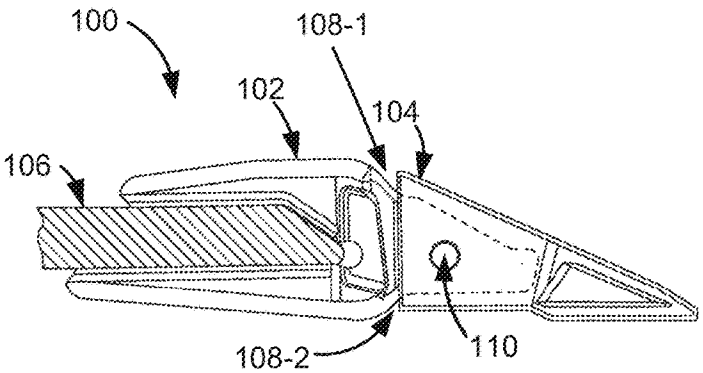

FIGS. 1A-1B are diagrams of an example wear part assembly 100. As shown in FIGS. 1A-1B, the wear part assembly 100 may include an adapter 102 for a wear part 104 (also referred to as a tip, a tooth, or a ground engaging tool (GET), among other examples). The adapter 102 may be configured to attach to and/or cover an edge of an implement 106 (e.g., a blade, a loader bucket, an excavator bucket, or any other implement having an earth-engaging or material-engaging edge that is subject to wear while in service). The wear part 104 may be configured to attach to the adapter 102 and may be configured to protect the edge of the implement 106 by covering the edge of the implement 106 and engaging with earth or material while the implement 106 is in service.

As shown in FIGS. 1A-1B, when attached to the adapter 102, the wear part 104 may extend outwardly from the edge of the implement 106 for engagement with the earth or the material (not shown). Furthermore, at least one joint 108 may be formed at an interface of the wear part 104 and the adapter 102 (e.g., where a portion of the wear part 104 meets a portion of the adapter 102). For example, as shown in FIGS. 1A-1B, a joint 108-1 may be formed on an upper surface of the wear part assembly 100 where an upper portion of the wear part 104 meets an upper portion of the adapter 102 and a joint 108-2 may be formed on a lower surface of the wear part assembly 100 where a lower portion of the wear part 104 meets a lower portion of the adapter 102.

The wear part 104 may include a retention mechanism (not shown) that secures the wear part 104 to the adapter 102. The retention mechanism may utilize aspects of the adapter 102 and the wear part 104, such as one or more retention apertures 110 on a side of the wear part 104, as shown in FIGS. 1A-1B, to secure the wear part 104 to the adapter 102 while the implement 106 is in service.

While a particular wear part assembly 100, adapter 102, and wear part 104 are shown in FIGS. 1A-1B, contemplated implementations include any type of wear part assembly, adapter, wear part, and/or the like (e.g., any coupler, mount, adapter, tooth, tip, lip shroud, cap, or any other GET), associated with an implement of a machine.

As indicated above, FIGS. 1A-1B are provided as an example. Other examples may differ from what is described in connection with FIGS. 1A-1B.

Figure 2A:
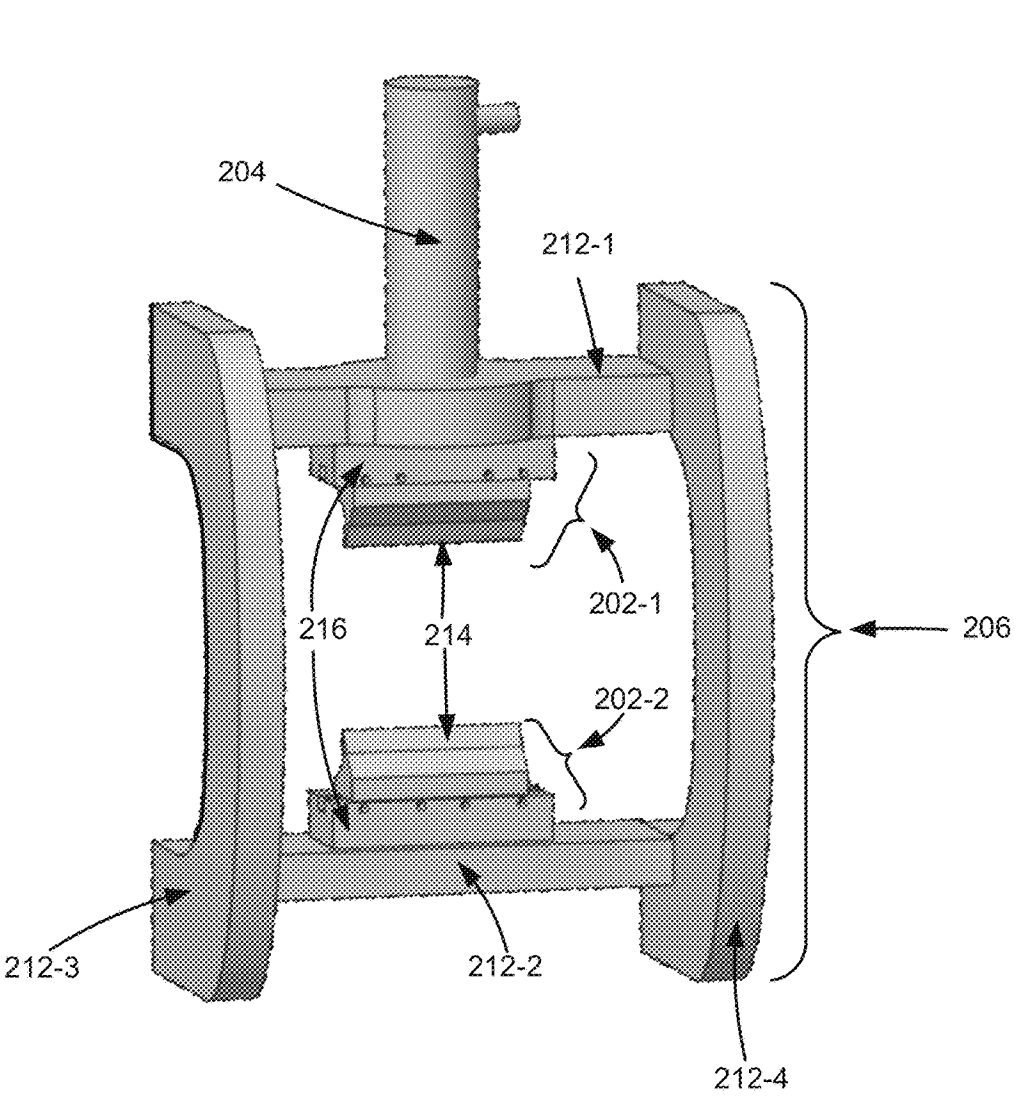
FIGS. 2A-2C are diagrams of an example wear part removal system described herein.
Figure 2B:
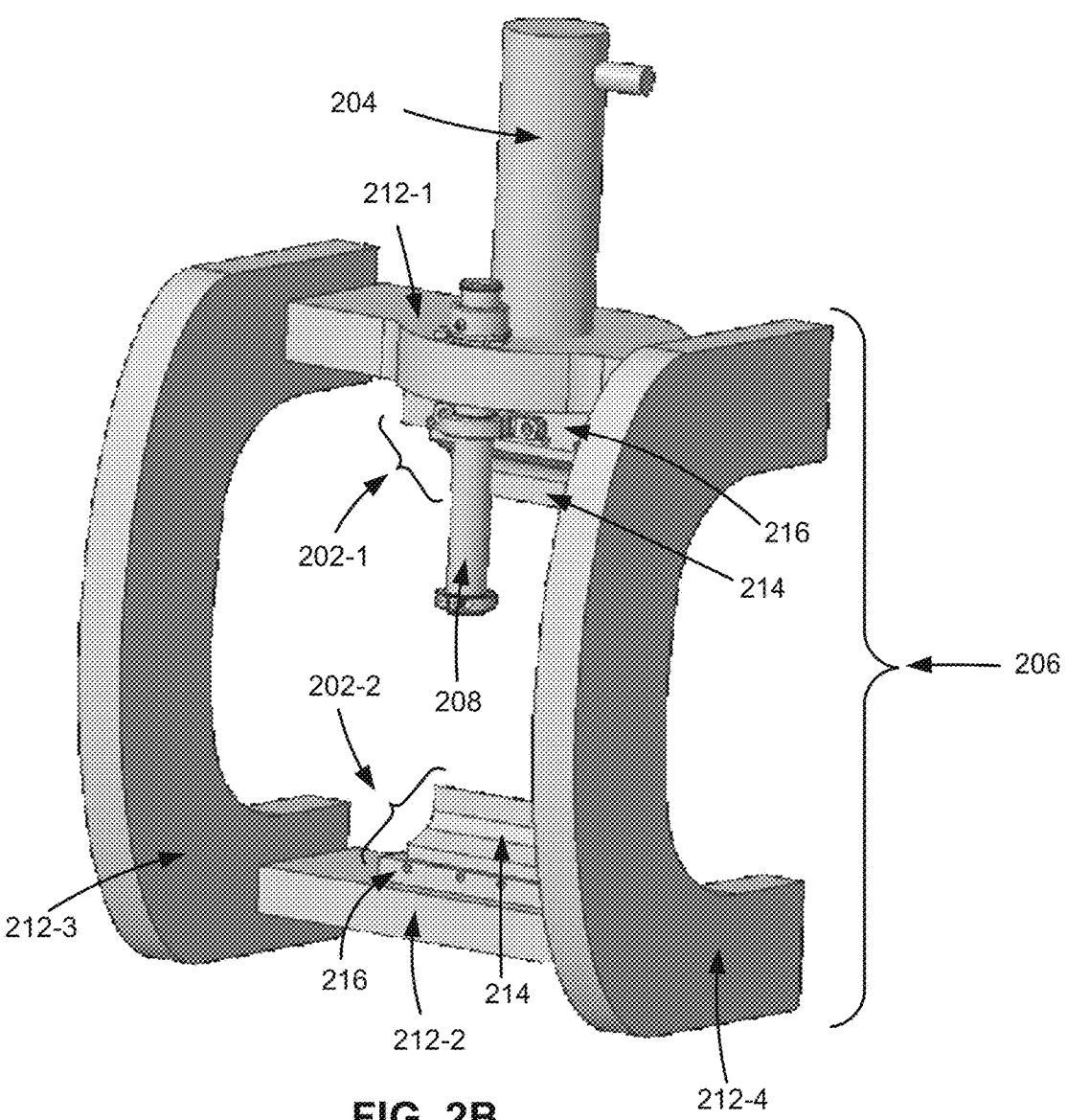
Figure 2C:
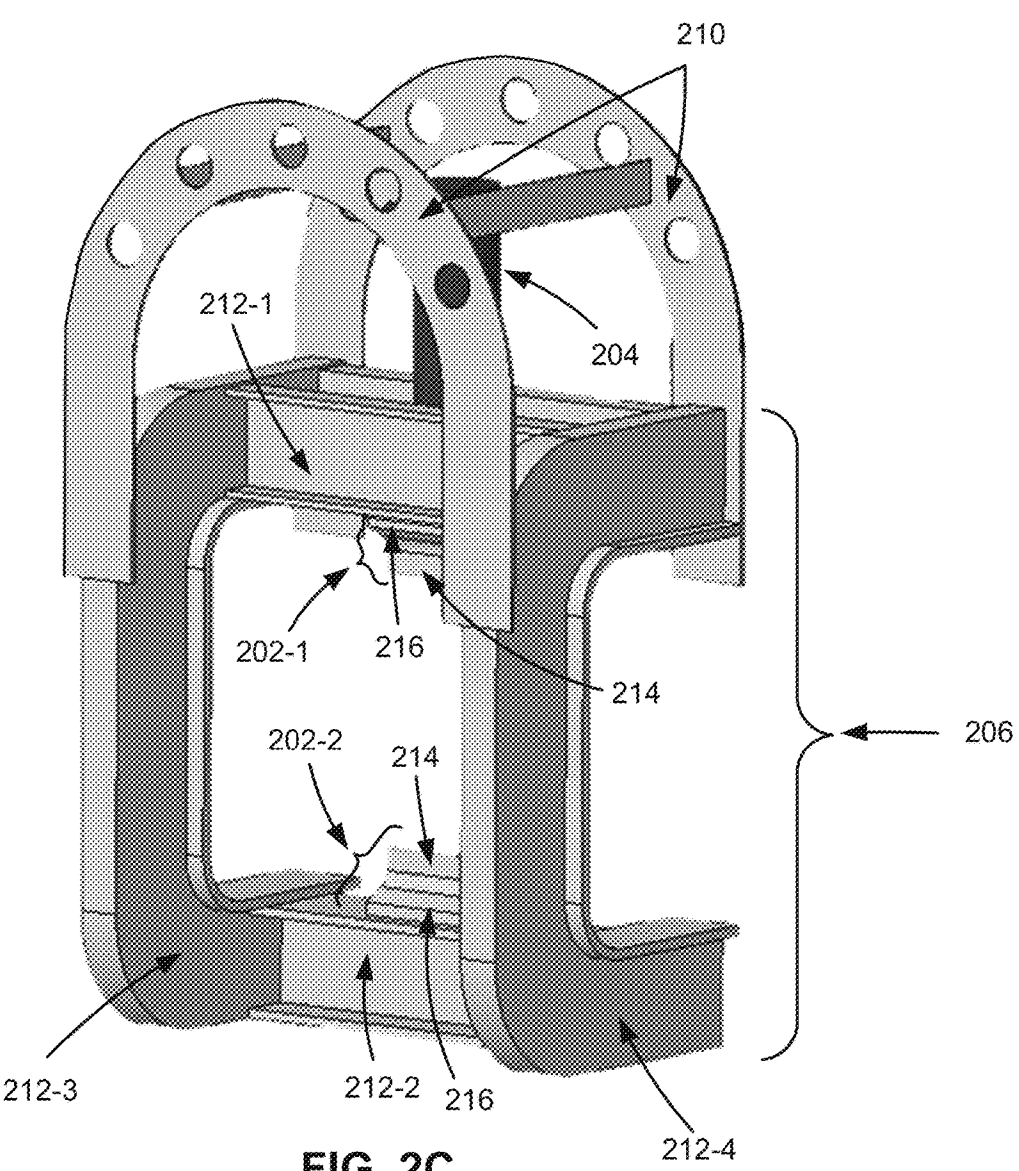

FIGS. 2A-2C are diagrams of an example wear part removal system 200 described herein. FIGS. 2A-2C show different angled front views of the wear part removal system 200. The wear part removal system 200 may be used to remove, or to facilitate removal, of a wear part 104 from an adapter 102 of a part assembly 100. As shown in FIGS. 2A-2C, the wear part removal system 200 includes one or more wedge assemblies 202 (shown as wedge assembly 202-1 and wedge assembly 202-2), a ram component 204, and a frame 206. As shown in FIG. 2B, the wear part removal system 200 may include a guide component 208. As shown in FIG. 2C, the wear part removal system may include at least one attachment component 210.

The frame 206 includes one or more structural components 212 that provide a physical structure to hold the one or more wedge assemblies 202 and the ram component 204. As shown in FIGS. 2A-2C, the frame 206 may include an upper structural component 212-1 (e.g., an upper horizontal beam) that is configured to hold (and/or to attach to) the wedge assembly 202-1 and a lower structural component 212-2 (e.g., a lower horizontal beam) that is configured to hold (and/or attach to) the wedge assembly 202-2. The upper structural component 212-1 may be configured to be approximately parallel to and/or approximately aligned with (e.g., in a vertical plane) the lower structural component 212-2. Accordingly, the upper structural component 212-1 may hold the wedge assembly 202-1 over the wedge assembly 202-2 such that the wedge assembly 202-1 is positioned approximately parallel to and/or approximately aligned with the wedge assembly 202-2. As further shown in FIGS. 2A-2C, the upper structural component 212-1 may be configured to hold (and/or to attach to) the ram component 204.

As further shown in FIGS. 2A-2C, the frame 206 may include a first side structural component 212-3 (e.g., a left vertical beam) and/or a second side structural component 212-4 (e.g., a right vertical beam) that are each configured to attach to the upper structural component 212-1 and the lower structural component 212-2. The first side structural component 212-3 and/or the second side structural component 212-4 may be configured to be approximately perpendicular to the upper structural component 212-1 and the lower structural component 212-2.

The first side structural component 212-3 and/or the second side structural component 212-4 may be configured to separate the upper structural component 212-1 from the lower structural component 212-2 such that a distance between the wedge assembly 202-1 and the wedge assembly 202-2 (e.g., when the ram component 204 is not activated or pressurized, as described below) may satisfy (may be greater than or equal to) a first distance threshold (e.g., that is associated with a height of the wear part 104 and/or a height of the wear part assembly 100). In some implementations, a distance between the first side structural component 212-3 and the second side structural component 212-4 may satisfy (may be greater than or equal to) a second distance threshold (e.g., that is associated with a width of the wear part 104 and/or a width of the wear part assembly 100). In this way, the frame 206 may be configured to fit around the wear part 104 and/or the wear part assembly 100 (e.g., to allow the wear part removal system 200 to interact with the wear part 104 to remove the wear part 104).

The first side structural component 212-3 and/or the second side structural component 212-4 may be configured to prevent the wear part removal system from contacting any other component of an implement 106 (e.g., another wear part assembly adjacent to the wear part assembly 100) when the wear part removal system 200 is in a position to interact with the wear part 104 (e.g., to remove the wear part 104). For example, as shown in FIGS. 2A-2C, the first side structural component 212-3 and the second side structural component 212-4 may have a "C" shape to provide clearance around other components of an implement 106 when the wear part removal system 200 is in a position to interact with the wear part 104. Further details regarding the shape of the first side structural component 212-3 and the second side structural component 212-4 are described herein in relation to FIG. 3C.

The ram component 204 may comprise, for example, a mechanical ram, a hydraulic ram, a pneumatic ram, or an electro-mechanical ram. For example, when the ram component 204 is a hydraulic ram, the ram component 204 may be connected to a hydraulic pump (not shown) that is configured to provide pressurized hydraulic fluid to the ram component. A control component (e.g., that is included in the example wear part removal system 200 or is part of another component, such as the hydraulic pump) may control the electro-mechanical ram. For example, an operator of the wear part removal system 200 may interact with the control component to cause the ram component 204 to activate or deactivate and/or pressurize or depressurize, among other examples.

The ram component 204 may be configured to move at least one wedge assembly 202, of the one or more wedge assemblies 202. For example, as shown in FIGS. 2A-2C, the ram component 204 may be connected to the wedge assembly 202-1 and may be configured to move the wedge assembly 202-1 downward (e.g., when the ram component 204 is activated and/or pressurized). Accordingly, when the ram component 204 is activated and/or pressurized, the ram component 204 may cause the wedge assembly 202-1 to move downward, contact a first joint 108 (e.g., joint 108-1) of the wear part assembly 100, and/or engage with the first joint 108 (e.g., generate and apply an engagement force on the wear part 104 and/or the adapter 102 via the first joint 108, as described herein). Additionally, or alternatively, this may cause the wedge assembly 202-2 to engage with a second joint (e.g., joint 108-2) of the wear part assembly 100. For example, the downward movement of the wedge assembly 202-1 may reduce a distance between the wedge assembly 202-1 and the wedge assembly 202-2, which may cause the wedge assembly 202-2 to contact the second joint 108 and/or engage with the second joint 108 (e.g., generate and apply an engagement force on the wear part 104 and/or the adapter 102 via the second joint 108, as described herein).

A wedge assembly 202, of the one or more wedge assemblies 202, may include a wedge component 214 and/or a wedge component saddle 216. The wedge component 214 may be configured to engage with a joint 108 of a wear part assembly 100. For example, the wedge component 214 may be configured to insert into (or onto) the joint 108 and to apply an engagement force (e.g., a vertical force) that, due to physical characteristics of the wedge component 214, generates a pushing force (e.g., a horizontal force) on the wear part 104 and/or the adapter 102 (e.g., a pushing force to push the wear part off the adapter 102). The wedge component saddle 216 may be configured to hold the wedge component 214 (e.g., provide structural support for the wedge component 214) and to attach the wedge component 214 to the frame 206. Further description regarding the wedge assembly 202, the wedge component 214, and the wedge component saddle 216 is described herein in relation to FIGS. 4A-4D.

As shown in FIG. 2B, the guide component 208 may be connected to the frame 206 (e.g., the upper structural component 212-1). The guide component 208 may include a slide guide and/or other component configured to facilitate linear movement of the ram component 204 and/or the wedge assembly 202-1 (e.g., when the ram component 204 is activated and/or pressurized). In this way, the guide component 208 may prevent the ram component 204 and/or wedge assembly 202-1 (e.g., that comprises a wedge component 214 and/or a wedge component saddle 216) from twisting and/or bending when the wedge assembly engages with a joint 108 of a wear part assembly 100. Further, the guide component 208 may assist the wedge assembly 202-1 in generating an engagement force on the joint 108 in an intended direction (e.g., a vertical, downward direction) to cause generation of a pushing force in an intended direction (e.g., a horizontal direction) on the wear part 104 and/or the adapter 102.

As shown in FIG. 2C, the at least one attachment component 210 may be connected to the frame 206 (e.g., the upper structural component 212-1). The at least one attachment component may include one or more points (e.g., suspension points) that are configured to attach to a lifting device (e.g., a boom of a crane) via rigging or other supporting material. Accordingly, the wear part removal system 200 may be positioned (e.g., suspended) over or proximate to the wear part 104 and/or the wear part assembly 100 by the lifting device via the at least one attachment component 210 (e.g., to allow the wear part removal system 200 to interact with the wear part 104 to remove the wear part 104).

As indicated above, FIGS. 2A-2C are provided as an example. Other examples may differ from what is described in connection with FIGS. 2A-2C.

Figure 3A:
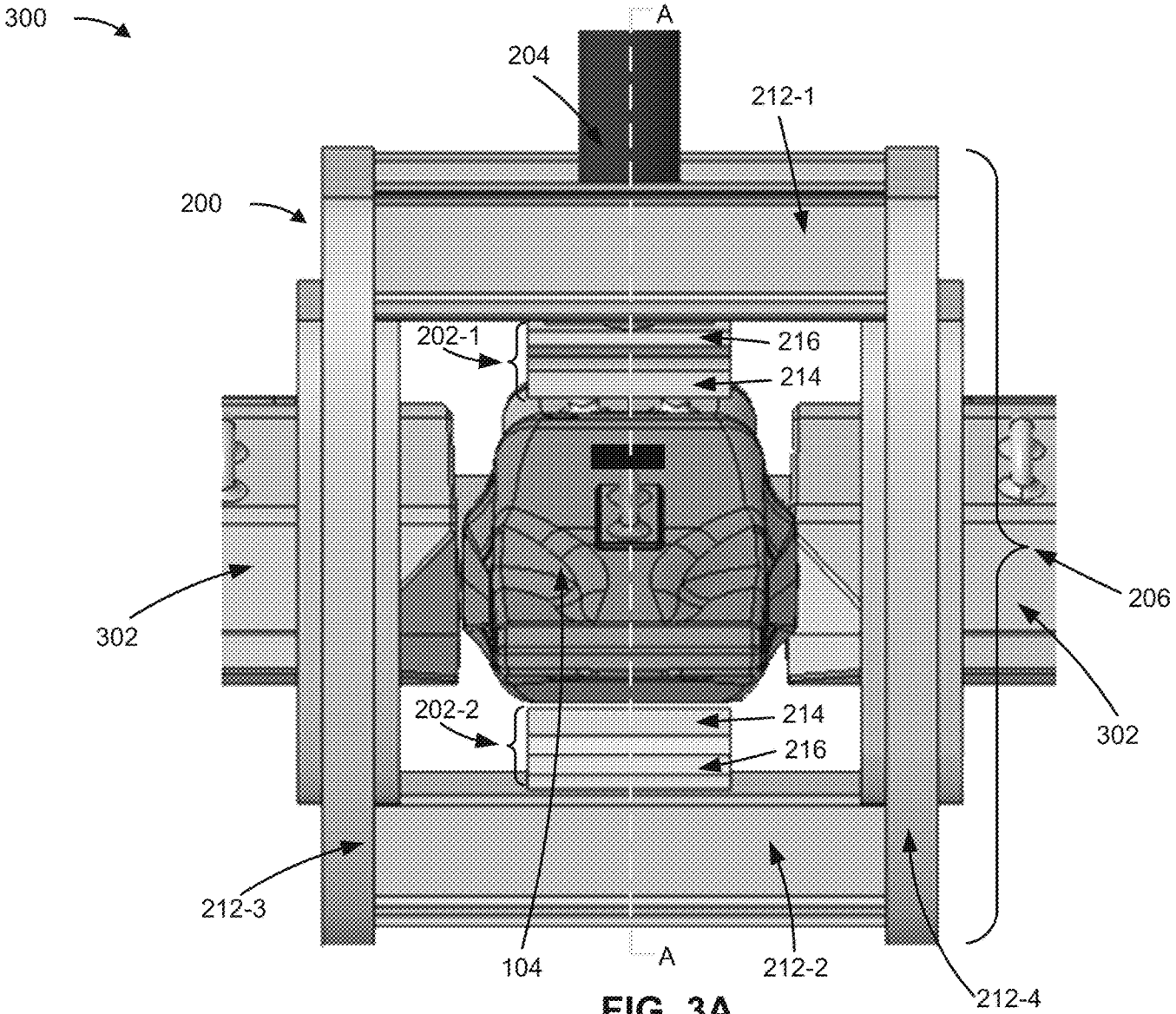
FIGS. 3A-3C are diagrams of the example wear part removal system in a position to interact with a wear part of the wear part assembly described herein.
Figure 3B:
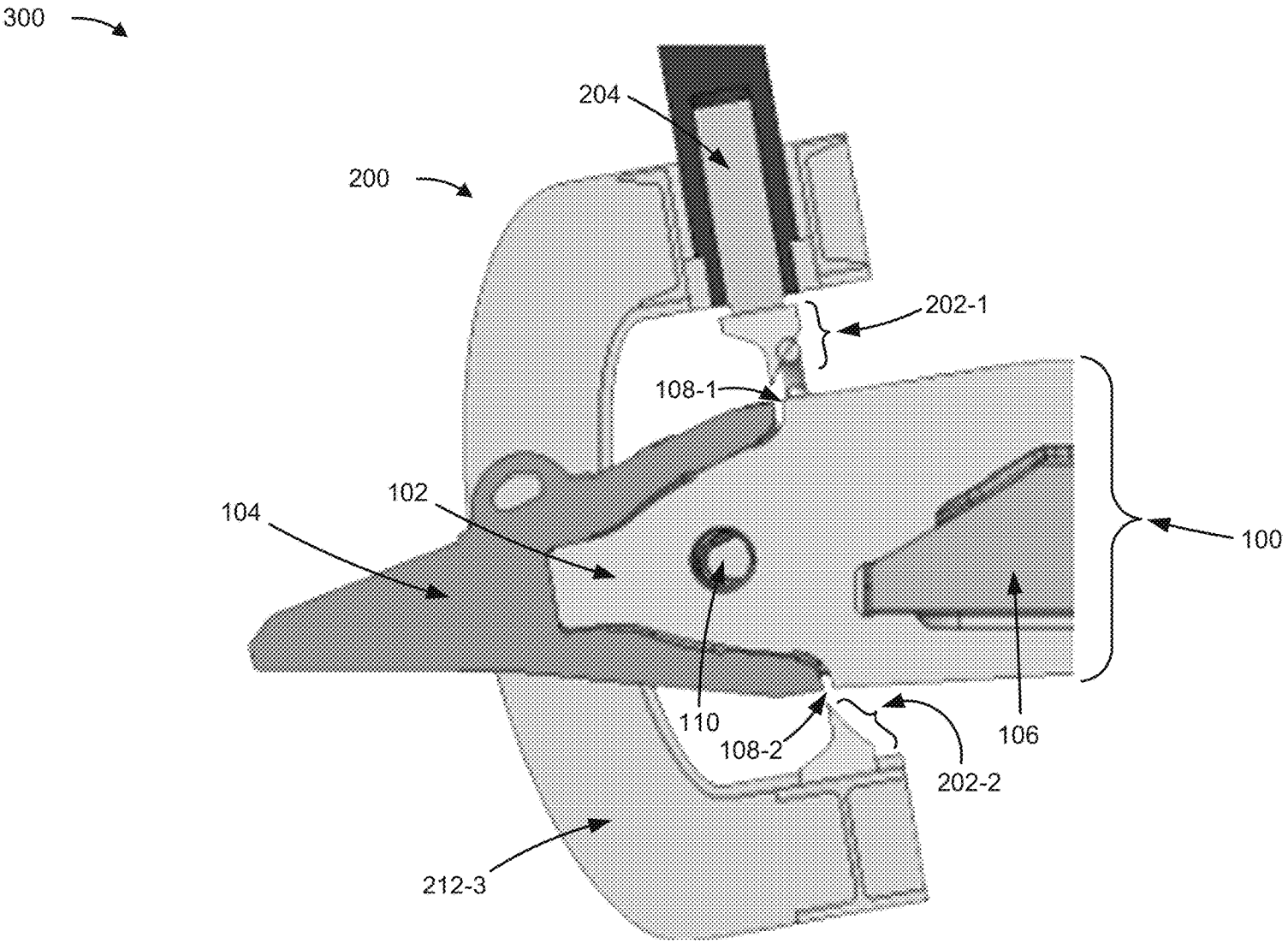
Figure 3C:
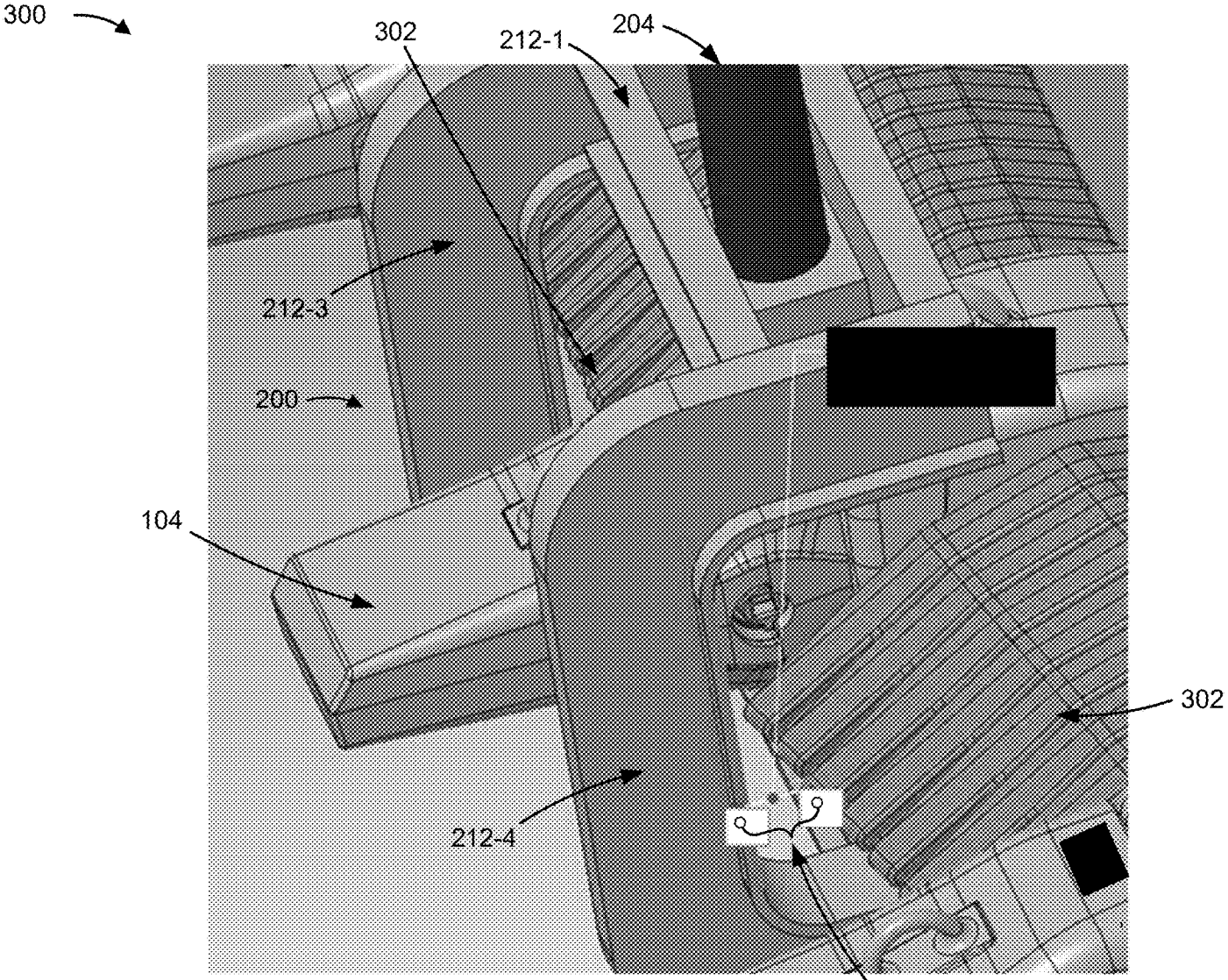

FIGS. 3A-3C are diagrams of the example wear part removal system 200 in a position 300 to interact with a wear part 104 of a wear part assembly 100. FIG. 3A is a front view of the wear part removal system 200 in the position 300. As shown in FIG. 3A, the frame 206 may fit around (e.g., surround) the wear part 104. For example, the wear part removal system 200 may be positioned (e.g., by a lifting device) such that the upper structural component 212-1 is disposed over an upper surface of wear part 104, the lower structural component 212-2 is disposed under a lower surface of the wear part 104, the first side structural component 212-3 (e.g., the left side structural component) is disposed beside (e.g., to the left of) a first surface (e.g., a left surface) of the wear part 104, and the second side structural component 212-4 (e.g., the right side structural component) is disposed beside (e.g., to the right of) a second surface (e.g., a right surface) of the wear part 104. In this way, the wedge assembly 202-1 may be aligned with (e.g., disposed over) a first joint 108 (e.g., joint 108-1, not shown in FIG. 3A) associated with the wear part 104 and the wedge assembly 202-2 may be aligned with (e.g., disposed under) a second joint 108 (e.g., joint 108-2, not shown in FIG. 3A) associated with the wear part 104. As further shown in FIG. 3A, the ram component 204 is not activated and/or pressurized, and therefore the wedge assembly 202-1 and the wedge assembly 202-2 are not contacting or engaging with the first joint 108 and the second joint 108.

As further shown in FIG. 3A, the wear component may be adjacent to one or more other wear components 302 (e.g., lip shrouds) associated with the implement 106. Accordingly, the position 300 of the wear part removal system 200 may cause the first side structural component 212-3 and/or the second side structural component 212-4 to be disposed over and/or under the one or more other wear components 302. As further described herein, the first side structural component 212-3 and/or the second side structural component 212-4 may be configured (e.g., have a "C" shape) to avoid contacting the one or more other wear components 302 when the wear part removal system 200 is in the position 300.

FIG. 3B is a cross-sectional view of the wear part removal system 200 and the wear part 104 along line A-A of FIG. 3A. As shown in FIG. 3B, the wear part removal system is in the position 300 to interact with the wear part 104 of the wear part assembly 100. As further shown in FIG. 3B, the wedge assembly 202-1 may be aligned with (e.g., disposed over) a joint 108-1 of the wear part assembly 100 and the wedge assembly 202-2 may be aligned with (e.g., disposed under) a joint 108-2 of the wear part assembly 100. As described above, when the ram component 204 is activated and/or pressurized, the ram component 204 may cause the wedge assembly 202-1 to move and engage with the joint 108-1 and may cause the wedge assembly 202-1 to engage with the joint 108-2. When the wedge assembly 202-1 engages with the joint 108-1 (e.g., the wedge assembly 202-1 drives into the joint 108-1), the wedge assembly 202-1 may generate a first engagement force (e.g., that is approximately parallel to a direction of movement of the wedge assembly 202-1 and/or the ram component 204) on the wear part 104 and/or an adapter 102 of the wear part assembly 100. When the wedge assembly 202-1 engages with the joint 108-2, the wedge assembly 202-2 may generate a second engagement force (e.g., that is approximately parallel to, but opposite in direction of the first engagement force) on the wear part 104 and/or the adapter 102. Generation of the first engagement force on the joint 108-1 may generate a first pushing force (e.g., that is approximately perpendicular to the direction of the first engagement force) on the wear part 104 and/or the adapter 102. Generation of the second engagement force on the joint 108-1 may generate a second pushing force (e.g., that is approximately perpendicular to the direction of the first engagement force) on the wear part 104 and/or the adapter 102. For example, as shown in FIG. 3B, the first pushing force and/or the second pushing force may cause the wear part 104 to move in a leftward direction off the adapter 102. In this way, the wear part 104 may be removed from the adapter 102.

FIG. 3C is an angled side view of the wear part removal system 200 in the position 300. As shown in FIG. 3C, the wear part removal system 200 may fit around the wear part 104 when the wear part removal system 200 is in the position 300. As further shown in FIG. 3C, the wear part 104 may be adjacent to the one or more other wear components 302. In some implementations, the first side structural component 212-3 and/or the second side structural component 212-4 may be configured to be disposed over and/or under the one or more other wear components and to avoid contacting the one or more other wear components 302 when the wear part removal system 200 is in the position 300. For example, as shown in FIG. 3C, each of the first side structural component 212-3 and the second side structural component 212-4 may be configured to have a "C" shape to allow the first side structural component 212-3 and the second side structural component 212-4 to be disposed around the one or more other wear components 302 when the wear part removal system 200 is in the position 300. Accordingly, the first side structural component 212-3 and/or the second side structural component 212-4 may maintain at least a distance 304 from the one or more other wear components 302.

As indicated above, FIGS. 3A-3C are provided as an example. Other examples may differ from what is described in connection with FIGS. 3A-3C.

Figure 4A:
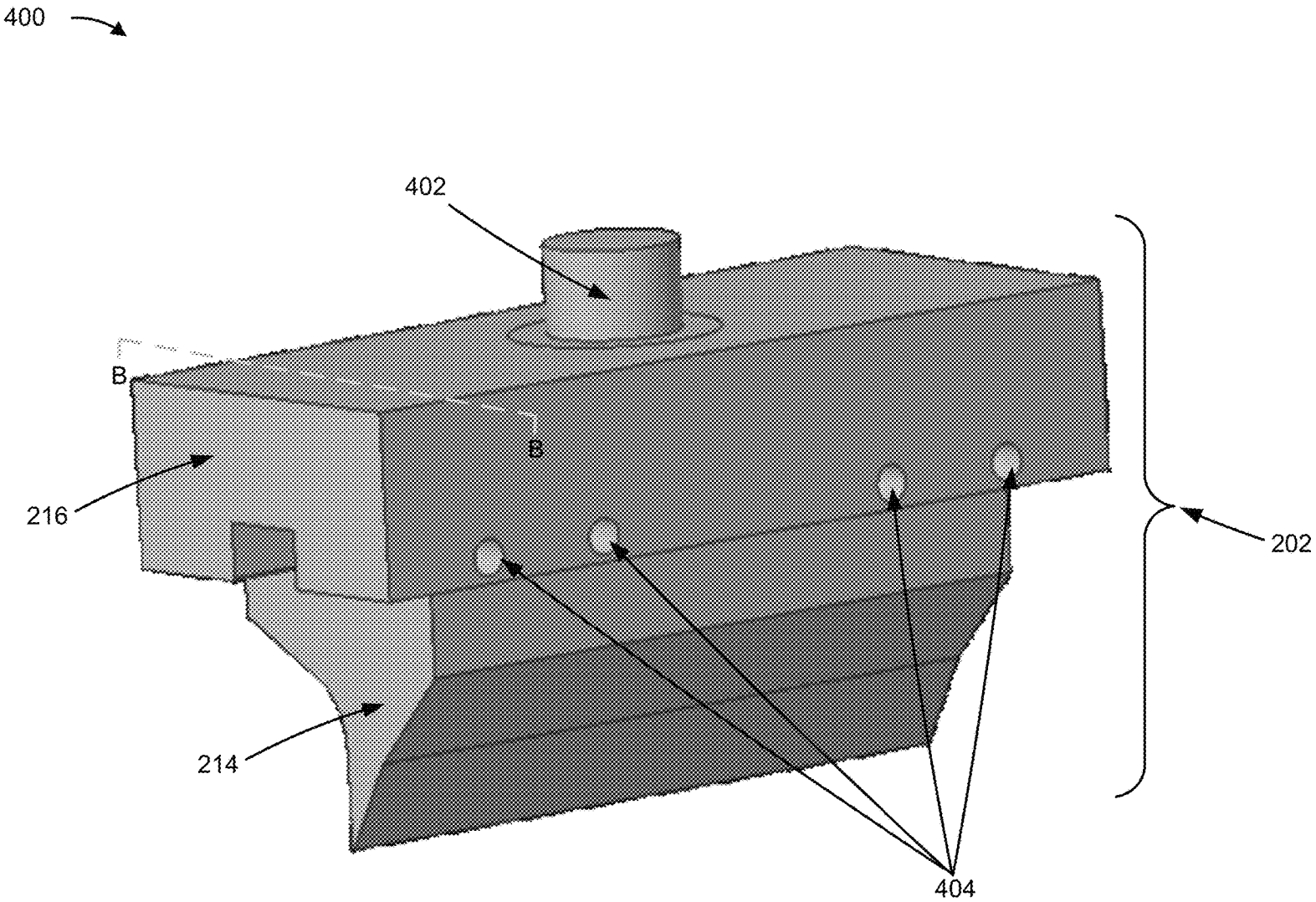
FIGS. 4A-4D are diagrams of example implementations of a wedge assembly of the wear part removal system described herein.
Figure 4B:
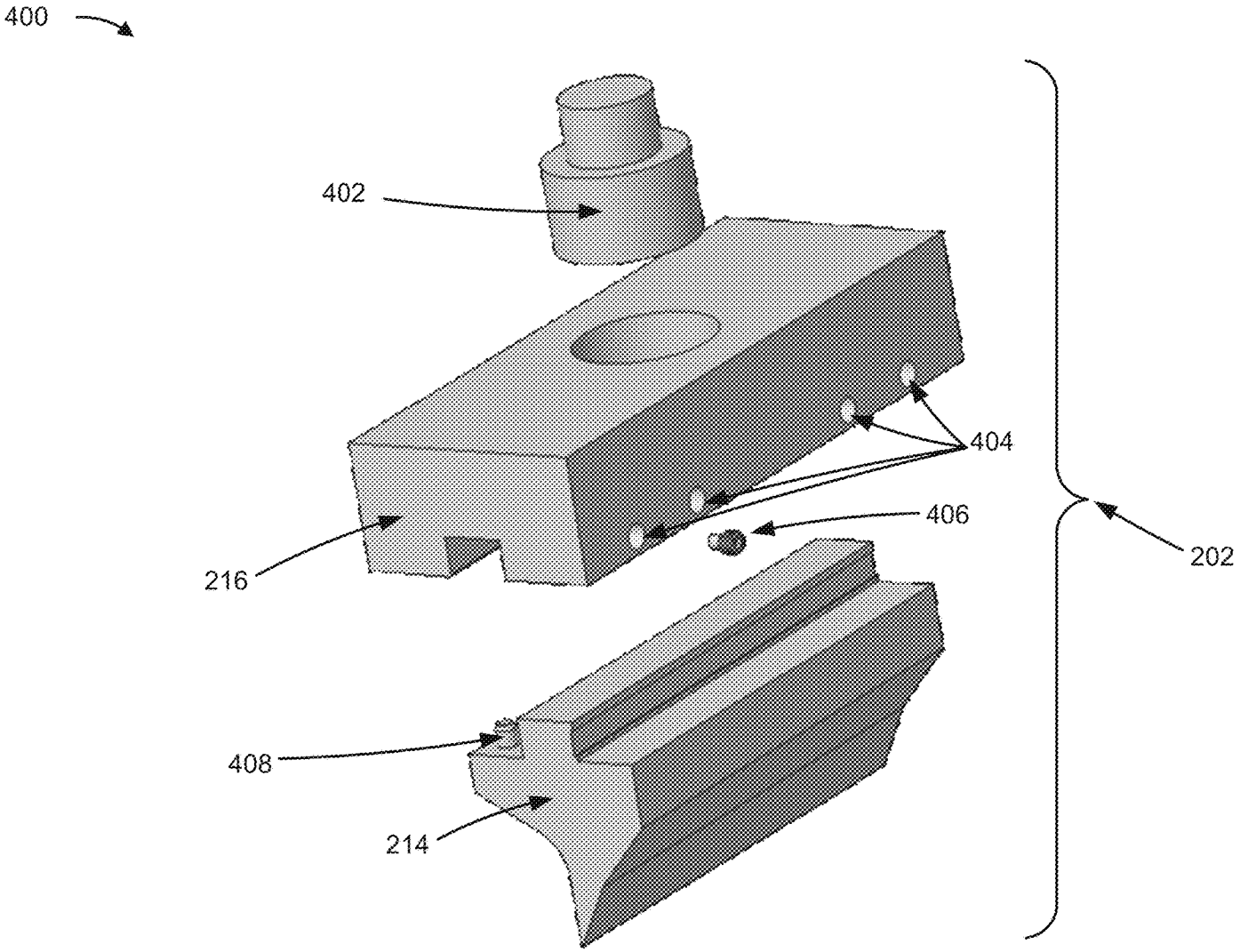
Figure 4C:
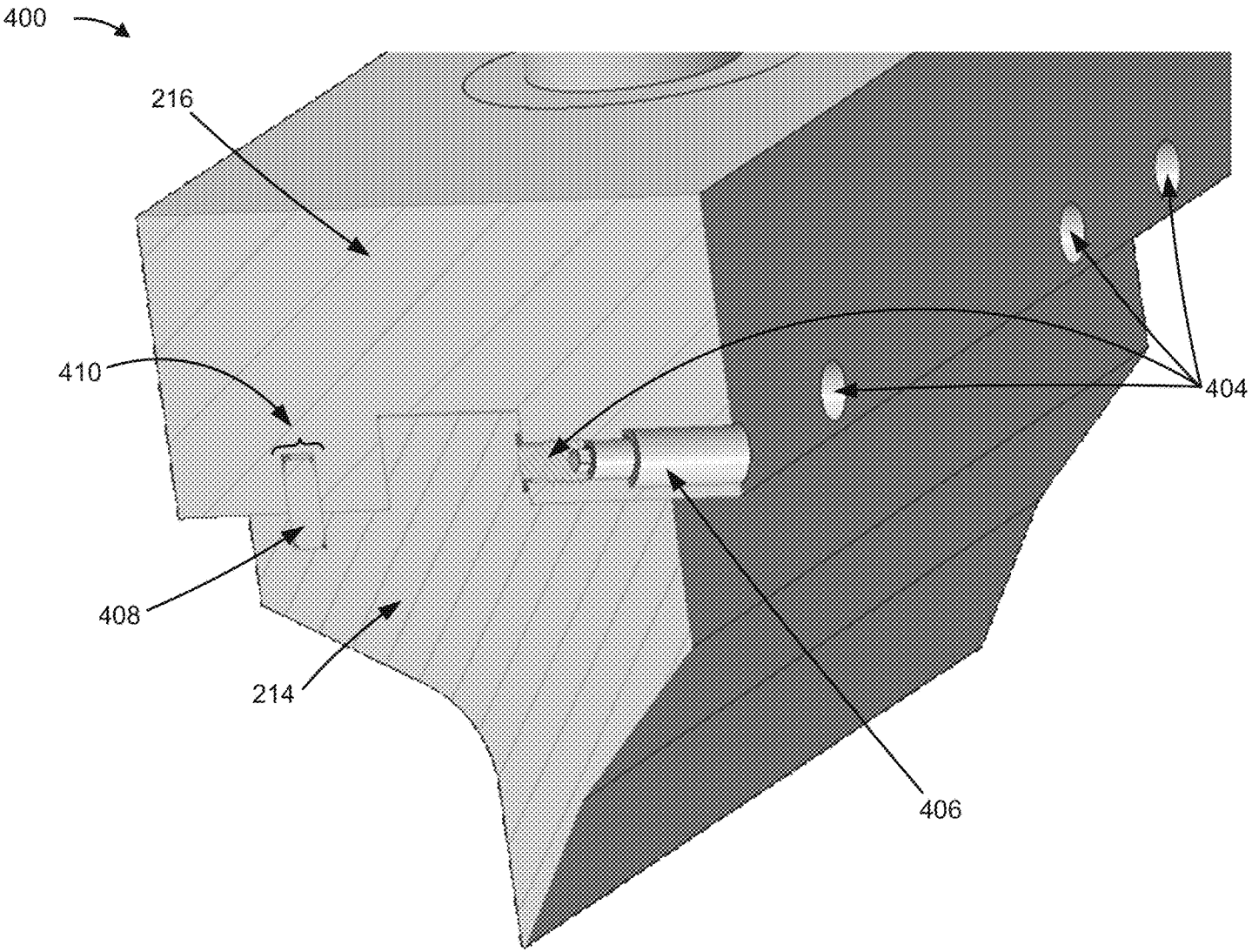
Figure 4D:
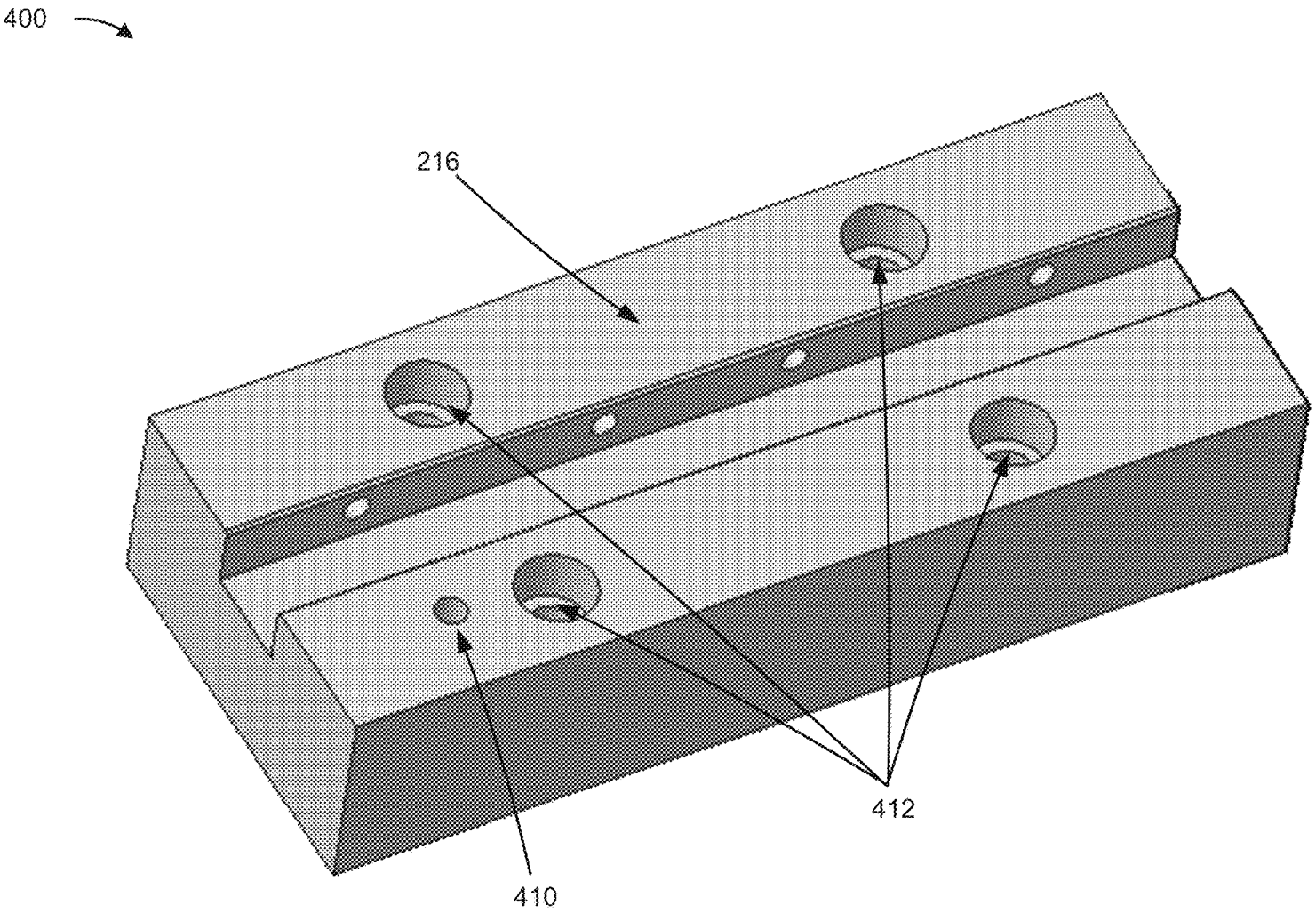

FIGS. 4A-4D are diagrams of example implementations 400 of the wedge assembly 202. FIG. 4A is an angled front view of the wedge assembly 202. FIG. 4B is an exploded, angled front view of the wedge assembly 202. FIG. 4C is a cross-sectional view of the wedge assembly 202 along line B-B of FIG. 4A. FIG. 4D is an angled top view of a wedge component saddle 216 of the wedge assembly 202.

As shown in FIGS. 4A-4D, the wedge assembly 202 may include a wedge component 214, a wedge component saddle 216, and/or an attachment component 402. As described above, the wedge component 214 may be configured to engage with a joint 108 of a wear part assembly 100. For example, the wedge component 214 may be configured to insert into (or onto) the joint 108 and to apply an engagement force (e.g., a vertical force) that, due to physical characteristics of the wedge component 214, generates a pushing force (e.g., a horizontal force) on a wear part 104 and/or an adapter 102 of a wear part assembly 100 (e.g., a pushing force to push the wear part 104 off the adapter 102). The wedge component saddle 216 may be configured to hold the wedge component 214 (e.g., in a recess of the wedge component saddle 216). The wedge component saddle 216 may be configured to attach to the attachment component 402, which may be configured to attach to the frame 206 of the wear part removal system 200. For example, the attachment component 402 may include a first threaded portion that is configured to screw into a threaded receptacle of the wedge component saddle 216 and/or may include a second threaded portion that is configured to screw into a threaded receptacle of the frame 206. In this way, the attachment component 402 may facilitate attachment of the wedge assembly 202 to the frame 206.

The wedge component saddle 216 may include one or more attachment holes 404 that allow one or more removable attachment components 406 to secure the wedge component 214 in the wedge component saddle 216 (e.g., when the wedge component 214 is positioned in the wedge component saddle 216). For example, the one or more removable attachment components 406 may include one or more set screws that insert and screw into the one or more attachment holes 404 and that are configured to maintain a secure attachment of the wedge component 214 to the wedge component saddle 216. The one or more removable attachment components 406 may be removed (e.g., unscrewed) to allow removal of the wedge component 214. In this way, a new wedge component may replace an old wedge component 214 that has been worn down or broken due to operation of the wear part removal system 200. This may improve a performance of the wear part removal system 200 over an operating life of the wear part removal system 200.

As shown in FIGS. 4B-4C, the wedge component 214 may include a first orientation component 408 that is configured to engage with a second orientation component 410 of the wedge component saddle 216. For example, the first orientation component 408 may be a protrusion (e.g., a dowel or other protrusion) and the second orientation may be an opening (e.g., a recess or aperture). The first orientation component 408 and the second orientation component 410 therefore may be configured to engage with each other (e.g., the first orientation component 408 may insert into the second orientation component 410). In this way, the first orientation component 408 and the second orientation component 410 may be configured to maintain a position of the wedge component 214 within the wedge component saddle 216 and/or may be configured to ensure a proper orientation of the wedge component 214 within the wedge component saddle 216 (e.g., ensure a front side of the wedge component is facing to the front in the wedge component saddle 216).

Additionally, or alternatively, as shown in FIG. 4D, the wedge component saddle may include one or more attachment holes 412 that facilitate attachment of the wedge component 214 to the wedge component saddle 216. The one or more attachment holes 412 may allow one or more additional removable attachment components (not shown), such as one or more bolts, to attach the wedge component 214 to the wedge component saddle 216 and that are configured to maintain a secure attachment of the wedge component 214 to the wedge component saddle 216.

As indicated above, FIGS. 4A-4D are provided as an example. Other examples may differ from what is described in connection with FIGS. 4A-4D.

INDUSTRIAL APPLICABILITY

Some implementations described herein provide a wear part removal system that enables removal of a wear part of a wear part assembly (e.g., from an adapter of the wear part assembly). The wear part removal system includes a first wedge assembly configured to engage with a first joint of the wear part assembly (e.g., a joint on an upper surface of the wear part assembly) and a second wedge assembly configured to engage with a second joint of the wear part assembly (e.g., a joint on a lower surface of the wear part assembly). The wear part removal system also includes a ram component that is configured to move the first wedge assembly (e.g., down towards the first joint) to cause the first wedge assembly to engage with the first joint and the second wedge assembly to engage with the second joint, which generates respective engagement forces on the first joint and the second joint and thereby generates a pushing force on the wear part to cause the wear part to be removed from the adapter of the wear part assembly.

In this way, the wear part removal system allows for removal of a wear part, regardless of whether the wear part is stuck on an adapter or mount (e.g., because of impacted fines, dust, or dirt). Further, the wear part removal system allows for removal of the wear part without an operator of the wear part removal system manually applying force, such as with hand tools (e.g., a sledge hammer to deliver hammer blows) or other tools (e.g., a jack hammer to apply a percussive force), to the wear part removal system. Moreover, because the wear part removal system is configured to engage multiple joints of a wear part assembly and to generate a pushing force on the wear part via multiple different engagement forces, the wear part removal system is able to quickly and efficiently remove wear parts that would otherwise be difficult and/or time consuming to remove using conventional removal techniques. Additionally, the wear part removal system is able to engage with at least one joint of a wear part assembly, even when the wear part is smooth from wear or otherwise damaged and/or the wear part is wet, muddy, or covered in ice, and therefore can facilitate removal of the wear part in adverse environmental conditions.

What is claimed is:

1. A wear part removal system, comprising:

a first wedge assembly configured to engage with a first joint associated with a wear part, wherein the first joint associated with the wear part is located on an upper surface of a wear part assembly that includes the wear part;

a second wedge assembly configured to engage with a second joint associated with the wear part, wherein the second joint associated with the wear part is located on a lower surface of the wear part assembly;

a ram component configured to cause the first wedge assembly to engage with the first joint associated with the wear part and to cause the second wedge assembly to engage with the second joint associated with the wear part;

a frame configured to hold the first wedge assembly, the second wedge assembly, and the ram component; and a guide component configured to facilitate linear movement of one or more of the ram component or the first wedge assembly, wherein the guide component is between a first side of the frame and a second side of the frame.

2. The wear part removal system of claim 1, wherein the ram component comprises:

a mechanical ram;

a hydraulic ram;

a pneumatic ram; or an electro-mechanical ram.

3. The wear part removal system of claim 1, wherein the frame is configured to hold the first wedge assembly over the upper surface of the wear part and to hold the second wedge assembly under the lower surface of the wear part when the wear part removal system is in a position to interact with the wear part.

4. The wear part removal system of claim 1, wherein the wear part is attached to an adapter associated with an implement of a machine, wherein:

the frame is configured to hold the first wedge assembly over the upper surface of the wear part and to hold the second wedge assembly under the lower surface of the wear part when the wear part removal system is in a position to interact with the wear part, and the frame is configured to prevent the wear part removal system from contacting any other component associated with the implement when the wear part removal system is in the position to interact with the wear part.

5. The wear part removal system of claim 1, wherein the ram component is configured to generate a pushing force on the wear part when the ram component causes the first wedge assembly to engage with the first joint associated with the wear part and causes the second wedge assembly to engage with the second joint associated with the wear part.

6. The wear part removal system of claim 5, wherein a direction associated with the pushing force is approximately perpendicular to a direction associated with an engagement force generated by the first wedge assembly when the first wedge assembly engages with the first joint associated with the wear part.

7. The wear part removal system of claim 1, wherein a wedge assembly, of the first wedge assembly or the second wedge assembly, comprises:

a wedge component configured to engage with a joint associated with the wear part;

a wedge component saddle configured to hold the wedge component; and an attachment component configured to attach the wedge component saddle to the frame.

8. The wear part removal system of claim 7, wherein the wedge component comprises a first orientation component and the wedge component saddle comprises a second orientation component, wherein the first orientation component is configured to engage with the second orientation component to facilitate positioning of the wedge component within the wedge component saddle.

9. A wear part removal system, comprising:

a first wedge assembly configured to engage with a first joint associated with a wear part;

a second wedge assembly configured to engage with a second joint associated with the wear part; and a ram component configured to cause the first wedge assembly to engage with the first joint associated with the wear part and to cause the second wedge assembly to engage with the second joint associated with the wear part;

a frame configured to hold the first wedge assembly, the second wedge assembly, and the ram component, wherein the frame is configured to hold the first wedge assembly over an upper surface of the wear part and to hold the second wedge assembly under a lower surface of the wear part when the wear part removal system is in a position to interact with the wear part; and a guide component configured to facilitate linear movement of one or more of the ram component or the first wedge assembly, wherein the guide component is between a first side of the frame and a second side of the frame.

10. The wear part removal system of claim 9, wherein the ram component is connected to the first wedge assembly, wherein the ram component is configured to move the first wedge assembly to cause the first wedge assembly to engage with the first joint associated with the wear part, wherein the ram component is configured to, when moving the first wedge assembly to cause the first wedge assembly to engage with the first joint associated with the wear part, cause the second wedge assembly to engage with the second joint associated with the wear part.

11. The wear part removal system of claim 9, wherein the first wedge assembly and the second wedge assembly are configured to, when respectively engaging with the first joint associated with the wear part and the second joint associated with the wear part, to generate a pushing force on the wear part.

12. The wear part removal system of claim 9, further comprising one or more attachment components configured to attach to a lifting device to facilitate positioning the wear part removal system with respect to the wear part.

13. The wear part removal system of claim 9, wherein the first wedge assembly comprises: a wedge component, a wedge component saddle, and a removable attachment that secures the wedge component in the wedge component saddle.

14. The wear part removal system of claim 9, wherein the ram component is configured to cause the first wedge assembly to engage with the first joint associated with the wear part to generate a first engagement force on the wear part and to cause the second wedge assembly to engage with the second joint associated with the wear part to generate a second engagement force on the wear part.

15. The wear part removal system of claim 14, wherein a direction of the first engagement force is approximately opposite a direction of the second engagement force.

16. The wear part removal system of claim 14, wherein generation of the first engagement force and the second engagement force generates a pushing force on the wear part, wherein a direction of the pushing force is approximately perpendicular to at least one of a direction of the first engagement force or a direction of the second engagement force.

17. A wear part removal system, comprising:

a first wedge assembly configured to engage with a first joint associated with a wear part; a second wedge assembly configured to engage with a second joint associated with the wear part; a ram component configured to cause the first wedge assembly to engage with the first joint associated with the wear part and to cause the second wedge assembly to engage with the second joint associated with the wear part;

a frame configured to hold the first wedge assembly, the second wedge assembly, and the ram component, wherein a wedge assembly, of the first wedge assembly or the second wedge assembly, comprises: a wedge component configured to engage with the first joint or the second joint; a wedge component saddle configured to hold the wedge component; and an attachment component configured to attach the wedge component saddle to the frame; and a guide component configured to facilitate linear movement of one or more of the ram component or the first wedge assembly, wherein the guide component is between a first side of the frame and a second side of the frame.

18. The wear part removal system of claim 17, wherein the wedge component comprises a first orientation component and the wedge component saddle comprises a second orientation component, and wherein the first orientation component is configured to engage with the second orientation component to facilitate positioning of the wedge component within the wedge component saddle.

19. The wear part removal system of claim 17, wherein the wedge assembly further comprises:

a removable attachment that secures the wedge component in the wedge component saddle.

* * * * *